US009706628B2

(12) United States Patent
Feng et al.

(10) Patent No.: US 9,706,628 B2
(45) Date of Patent: Jul. 11, 2017

(54) DEVICE FOR FORMING AIR FLOW CONTAINING CHARGED IONS

(71) Applicants: BOE Technology Group Co., Ltd., Beijing (CN); Beijing BOE Display Technology Co., Ltd., Beijing (CN)

(72) Inventors: Hongzhuan Feng, Beijing (CN); Jian Wang, Beijing (CN); Jie Li, Beijing (CN); Huan Zhang, Beijing (CN)

(73) Assignees: BOE Technology Group Co., Ltd., Beijing (CN); Beijing BOE Display Technology Co., Ltd., Beijing (CN)

( * ) Notice: Subject to any disclaimer, the term of this patent is extended or adjusted under 35 U.S.C. 154(b) by 95 days.

(21) Appl. No.: 14/802,436

(22) Filed: Jul. 17, 2015

(65) Prior Publication Data

US 2016/0262248 A1 Sep. 8, 2016

(30) Foreign Application Priority Data

Mar. 5, 2015 (CN) ..... 2015 1 0098523

(51) Int. Cl.
*H01T 23/00* (2006.01)
*H05F 3/06* (2006.01)
(Continued)

(52) U.S. Cl.
CPC ..... *H05F 1/00* (2013.01); *H01T 19/04* (2013.01); *H01T 23/00* (2013.01)

(58) Field of Classification Search
CPC . H01T 23/00; H01T 19/04; H01T 9/04; H05F 3/04; H05F 3/06
(Continued)

(56) References Cited

U.S. PATENT DOCUMENTS 5,055,963 A * 10/1991 Partridge ..... H01T 23/00 250/423 R
6,717,792 B2 * 4/2004 Gorczyca ..... H01T 23/00 361/212
(Continued)

FOREIGN PATENT DOCUMENTS

CN 201797633 U 4/2011
CN 201916226 U 8/2011
(Continued)

OTHER PUBLICATIONS

Jul. 18, 2016—(CN)—First Office Action Appn 201510098523.9 with English Tran.
(Continued)

*Primary Examiner* — Dharti Patel
(74) *Attorney, Agent, or Firm* — Banner & Witcoff, Ltd.

(57) ABSTRACT

Embodiments of the present invention provide a device for forming air flow containing charged ions, comprising a fan member, a ring air blowing chamber defining a center opening, and an ionizing member, wherein, the ionizing member is arranged on an inner wall of the ring air blowing chamber facing the center opening for generating the charged ions, and the ring air blowing chamber comprises a ring passage and a nozzle part, the ring passage of the ring air blowing chamber is configured to receive air flow from the fan member, and the nozzle part is configured to face to the ionizing member.

13 Claims, 3 Drawing Sheets

(51) Int. Cl.
*H05F 1/00* (2006.01)
*H01T 19/04* (2006.01)

(58) Field of Classification Search
USPC ..... 361/213
See application file for complete search history.

(56) References Cited

U.S. PATENT DOCUMENTS

| | | | | |
|---|---|---|---|---|
| 7,940,509 | B2 * | 5/2011 | Orihara | B08B 1/00 361/230 |
| 2014/0301009 | A1 * | 10/2014 | Ogawa | H01T 23/00 361/231 |

FOREIGN PATENT DOCUMENTS

| | | | |
|---|---|---|---|
| CN | 202050585 | U | 11/2011 |
| CN | 102933014 | A | 2/2013 |
| CN | 204087108 | U | 1/2015 |
| JP | 2009048985 | A | 3/2009 |
| KR | 20130119111 | A | 10/2013 |

OTHER PUBLICATIONS

Dec. 29, 2016—(CN) Second Office Action Appn 201510098523.9 with English Tran.

* cited by examiner

DEVICE FOR FORMING AIR FLOW CONTAINING CHARGED IONS

This application claims priority to Chinese Patent Application No. 201510098523.9 filed on Mar. 5, 2015. The present application claims priority to and the benefit of the above-identified application and is incorporated herein in its entirety.

TECHNICAL FIELD

Embodiments of the invention relate to a device for forming air flow containing charged ions

BACKGROUND

At present, in a Thin Film Transistor-Liquid Crystal Display (TFT-LCD) industry, dust and static electricity are two important factors affecting product quality, and are two of the most essential reasons for lower product quality. In particular, the static electricity has features such as latency, long-term, and uncertainty. In a conveying process, a TFT-LCD substrate constantly experiences friction, contact, adsorption, pressurizing, cooling, high temperatures and so on with a mechanical arm, an equipment table, a transport wheel, a guide rail, a conveying belt and so on, thus constantly generating static electricity. The substrate for TFT-LCD is made of glass, which belongs to insulating materials, so the static electricity is hard to dissipate once electrostatic adhesion occurs. Therefore, a lot of electrostatic charges will be accumulated on a surface of the substrate, and an electrostatic breakdown phenomenon may easily occur. Wherein, some of the defective static electricity can be detected by an inspection device, but some cannot be detected by the inspection device and will flow into a client, which causes a great risk in the product quality. It can be seen that, effectively removing the electrostatic adhesion on the TFT-LCD substrate is of considerably practical significance in ensuring the product quality.

SUMMARY

Embodiments of the present invention provide a device for forming air flow containing charged ions, comprising a fan member, a ring air blowing chamber defining a center opening, and an ionizing member, wherein, the ionizing member is arranged on an inner wall of the ring air blowing chamber facing the center opening for generating the charged ions, and the ring air blowing chamber comprises a ring passage and a nozzle part, the ring passage of the ring air blowing chamber is configured to receive air flow from the fan member, and the nozzle part is configured to face to the ionizing member.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DESCRIPTION OF THE EMBODIMENTS

Figure 1:
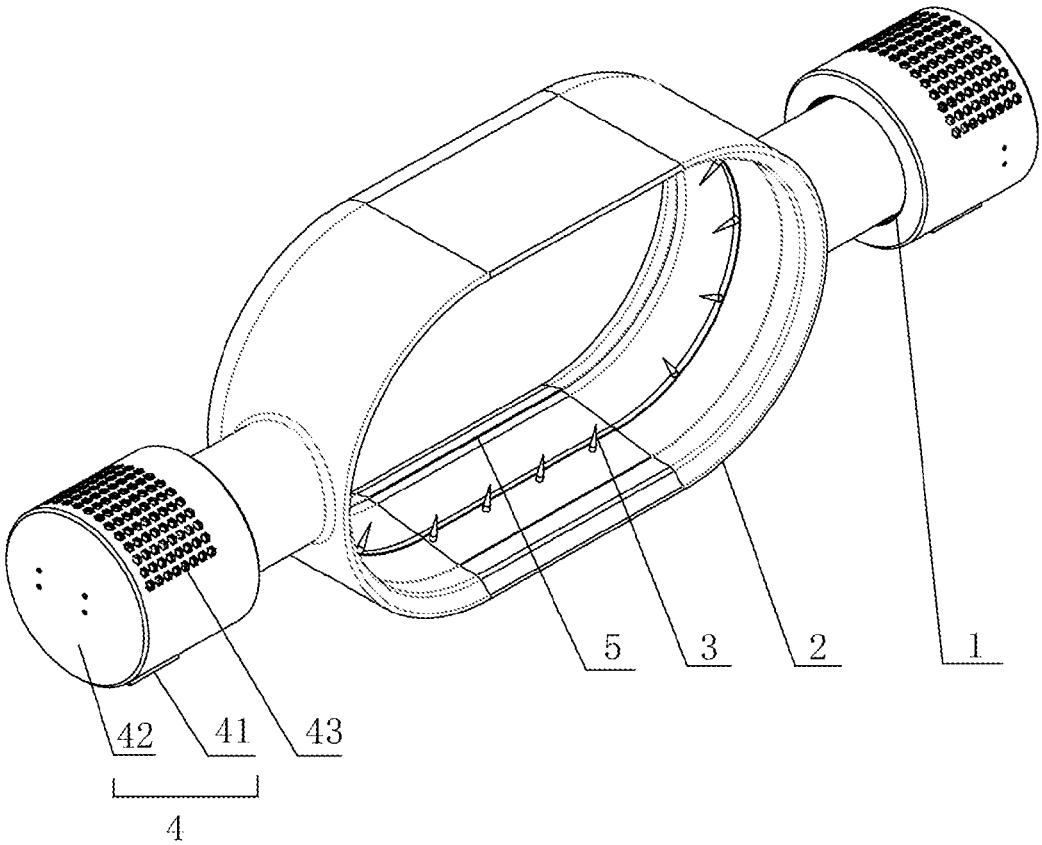
FIG. 1 is a stereoscopic diagram of a device for forming air flow containing charged ions provided by an embodiment of the present invention.

Technical solutions of the embodiment will be described in a clearly and fully understandable way in connection with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention.

In the description of the embodiments of the present invention, unless otherwise specified, "a plurality of" refers to two or more; azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. Those skilled in the art can understand the specific meanings of the above-mentioned terms in the embodiments of the present invention according to the specific circumstances.

In related arts, there are generally three types of static electricity removing methods, which are: an ion stick method, an ion blower method and an X-ray static electricity removing method. The three methods are used in different circumstances, and each has its advantages and disadvantages, and the general principle is that the static electricity is removed by delivering positive and negative ions via flowing air, wherein the flowing air is usually a dry air flow.

1) Ion stick method: charged ions are generated by using dry air to pass through a high-voltage electric field. Under the action of air flow, the charged ions move to a surface of a glass substrate to counteract charges on the glass substrate, thus achieving the effect of removing the static electricity. The method has shortcomings of lower utilization of air flow, and higher energy consumption; moreover, when an ion stick is used to remove the static electricity, a continuous supply of dry air is required, and the ion stick is often arranged in a linear form, so it can only process a glass substrate below it when passing by.

2) Ion blower method: an air flow is generated by a fan, and contains a lot of charged ions after passing through a high-voltage electric field. Under the action of the air flow, these charged ions move to a surface of a glass substrate to counteract charges on the glass substrate, thus achieving the effect of removing the static electricity. However, the existing ion blower method has shortcomings of higher energy consumption, continuously working of a fan, and lower working efficiency; moreover, there is a lack of interference with external objects when the fan rotates, and the cooling effect is not obvious.

3) X-ray static electricity removing method: when used for removing the static electricity, it has limitations such as a short distance, and a small region; moreover, X-ray has radiation risk to operators, which is not good for human health.

The inventor found that in the above related arts, there are problems of lower working efficiency of air flow, lower efficiency of removing the static electricity, failing to fast cool a glass substrate, and radiation risk.

Therefore, aim at the above shortcomings, embodiments of the present invention provide a device for forming air flow containing charged ions, used as a static electricity removing device, which is capable of improving working efficiency of air flow, effectively removing the static electricity, fast cooling a glass substrate and having no radiation risk.

In connection with FIG. 1, FIG. 2, FIG. 3 and FIG. 4, a device for forming air flow containing charged ions provided by an embodiment of the present invention comprises a fan member 1, a ring air blowing chamber 2 defining a center opening H, an ionizing member 3 and a control unit 4; under controlled by the control unit 4, the fan member 1 connected with the ring air blowing chamber 2 generates an air flow which further flow into the ring air blowing chamber 2; the ring air blowing chamber 2 includes a ring passage C configured to receive air flow from the fan member 1, and a ring nozzle part 5 facing the ionizing member 3 is arranged on a side of the air blowing chamber 2; the ring nozzle part 5 is configured to output at least part of the air flow from the ring passage C to the ionizing member 3. The ring passage C and the ring nozzle part 5 are communicated with each other. The ionizing member 3 for generating charged ions is for example arranged on an inner wall (IW) of the air blowing chamber 2 facing the center opening H. Under the action of air flow, these charged ions move to a surface of a glass substrate to counteract charges, thus achieving the effect of removing the static electricity. In the embodiment, the nozzle part 5 is in a ring shape, however, the embodiments of the present invention are not limited thereto; in other embodiments, the nozzle part may also be discontinuous.

Figure 5:
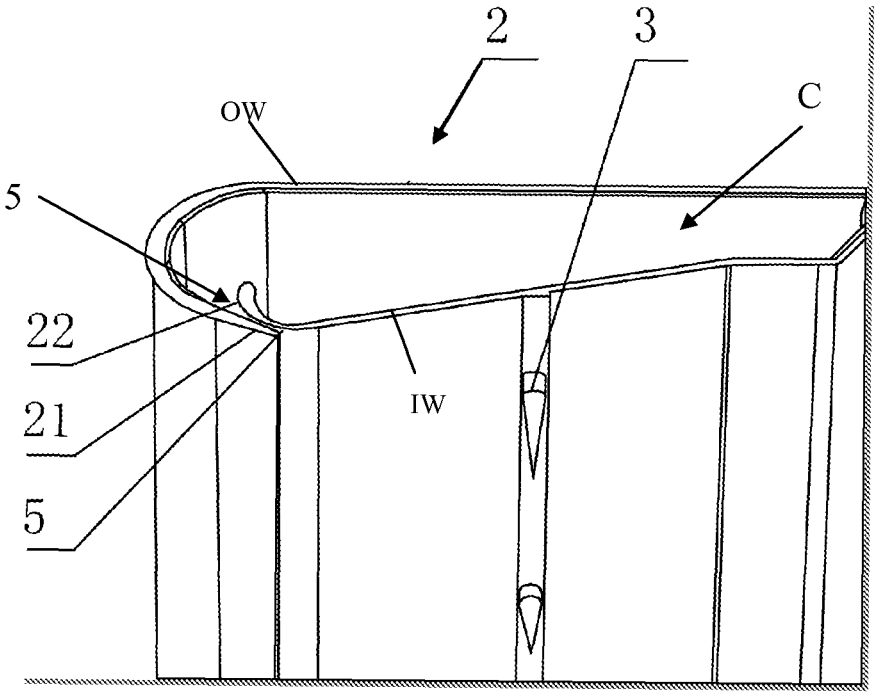
FIG. 5 is a cross-sectional diagram of a ring air blowing chamber of the device for forming air flow containing charged ions provided by the embodiment of the present invention.

As a main window for energy input and output, the air blowing chamber 2 can employ technologies in jet engine and automobile turbo so as to greatly increase air supplying volume under the same power, and a significant effect of removing the static electricity can be achieved. In particular, a key design is performed on the nozzle part 5, so as to achieve the purpose of increased and stable air supplying volume. As shown in FIG. 5, an extending wall 21 and an arc wall 22 are arranged on a side of the air blowing chamber 2 close to the nozzle part 5, one end of the arc wall 22 is bent inward to the passage C of the air blowing chamber 2, and the extending wall 21 is located outside of the arc wall 22. The nozzle part 5, i.e., a slit cut, is formed between the extending wall 21 and the arc wall 22. The arc wall 22 is much closer to the ring passage C as compared with the extending wall 21. The extending wall 21 and the arc wall 22 are arranged to be tangent to each other, ensuring that cold air flow fast flows to the ionizing member 3. Of course, a size of the slit cut can be flexibly decided according to the requirements on the air blowing chamber 2 and the air supplying volume.

It is noted that a cross-section of the air blowing chamber 2 in a horizontal direction can be in an ellipse-like ring shape, or can be in a round ring shape; in the embodiment, the cross-section of the air blowing chamber 2 in the horizontal direction, for example, is in an ellipse-like ring shape, has two arc cross section parts opposite to each other and two straight cross section parts located therebetween.

The air flow generated by the fan member 1 is flowed into the ring passage C of the air blowing chamber 2, then, ejected from the nozzle part 5 disposed on a ring edge of the air blowing chamber 2, and finally forms a continuous air flow for fast cooling. The air flow is an important condition for realizing greater air volume, because a shape of fluid is related with a viscosity of fluid, a discharge aperture and so on. When an Reynolds number is small, a viscous force of the fluid is stronger than an inertia force of the fluid. In this case, a flow rate of the fluid has weak response to external interference due to the action of the viscous force, so the fluid movement is more stable; In the case that the inertia force of the fluid is stronger than the viscous force of the fluid, at that time, the flow rate of the fluid has strong response to external interference, the fluid flow becomes unstable, small changes in the flow rate are easily enhanced, which may cause strong shocks. Therefore, because of the viscous force of air fluid, when a stream of fast cold air flow passes by, it will pull surrounding air to move along. In addition, since air pressures on both sides of the air blowing chamber 2 are not same, i.e., there is a negative pressure, resulting in entering of more air at a left side of the nozzle portion 5 (a side opposite to an opening direction of the nozzle part 5) so as to balance the air pressures. In view of above, the actual volume of blown air can be significantly increased due to the two effects, reaching 15 times of the preset air supplying volume of the fan member 1.

Figure 2:
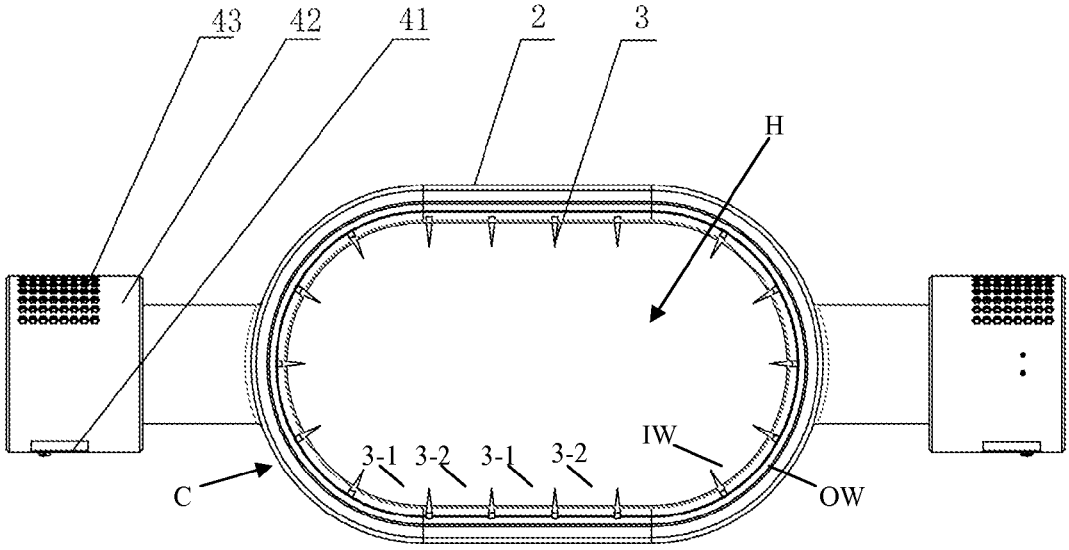
FIG. 2 is a front view of the device for forming air flow containing charged ions provided by the embodiment of the present invention.
Figure 3:
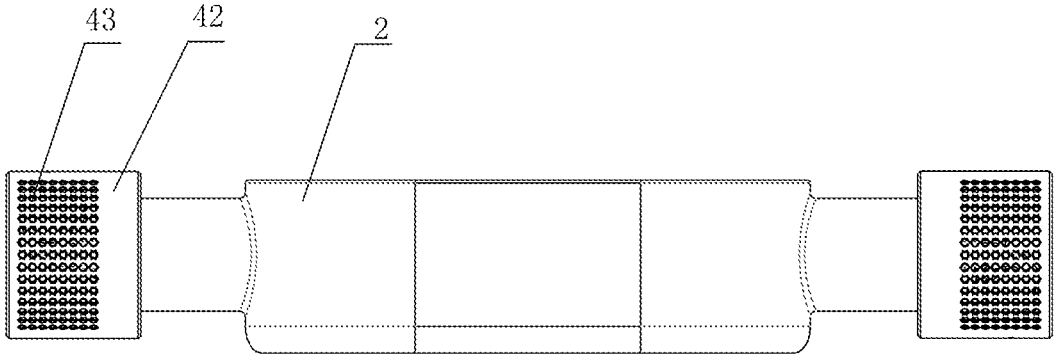
FIG. 3 is a top view of the device for forming air flow containing charged ions provided by the embodiment of the present invention.

In order to ensure continuity and security in operation of a whole set of devices, the number of the fan members 1, for example, is two, and the two fan members are arranged on an outer wall (OW) of the air blowing chamber 2 away from the center opening H. For example, the two fan members 1 are symmetrically arranged on two sides of the outer wall (OW) of the air blowing chamber 2. As shown in FIG. 2, the two fan members 1 are respectively located on two sides of the ring air blowing chamber corresponding to the two arc cross section parts. When one of the fan members 1 is failed or in maintenance, the other fan member 1 can continue to work, thus making the static electricity removing device maintain continuous work. It is noted that the number of the fan members 1 is not limited to two, and it can be one, or can be two or more, which can be flexibly adjusted according to specific situations.

Figure 4:
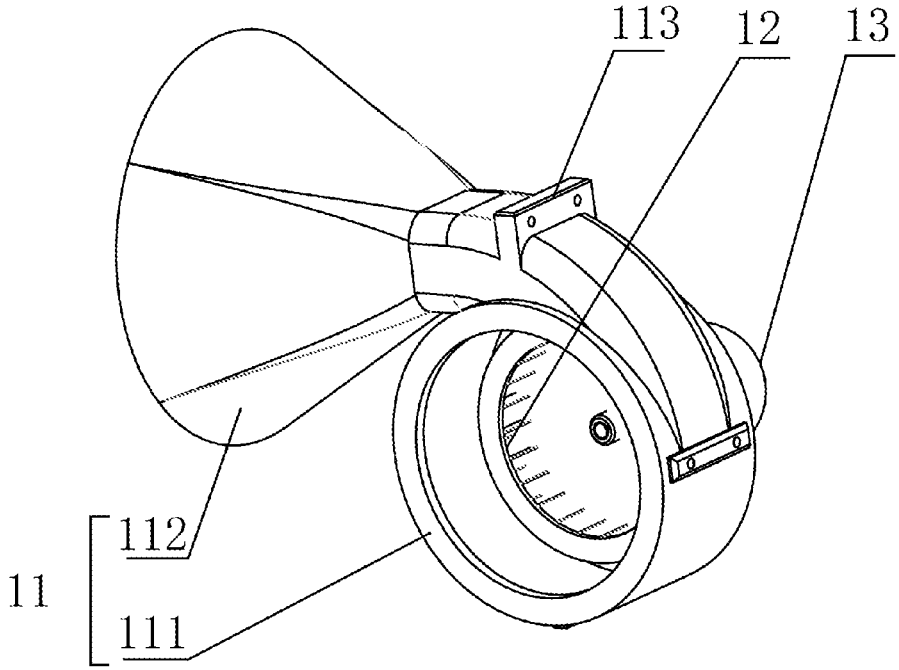
FIG. 4 is a stereoscopic diagram of a fan member of the device for forming air flow containing charged ions provided by the embodiment of the present invention.

As shown in FIG. 4, as an executing unit for extracting air flow, the fan member 1, for example, includes a shell 11, an impeller 12 and a motor 13; the shell 11 includes an air inlet part 111 and an air outlet part 112 connected with the air inlet part 111, and air passages are arranged in the air inlet part 111 and the air outlet part 112 respectively; the impeller 12 is provided at the air inlet part 111 and connected with the motor 13. Controlled by the control unit 4, the motor 13 drives the impeller 12 to rotate, so that air pressure at the impeller 12 is lower than external pressure, resulting in movement of surrounding air. Therefore, an air flow is formed and arrives at the air blowing chamber 2 after passing the air inlet part 111 and the air outlet part 112 sequentially.

Further, the air outlet part 112 has a horn shape to facilitate flowing of the air fluid; and an expanding end of the air outlet part 112 is connected with the air blowing chamber 2, while a contracting end of the air outlet part 112 is connected with the air inlet part 111. The expanding end of the air outlet part 112 has round mouth shape for convenience of assembling and preventing air flow leaking from seams. In addition, the air inlet part 111 has a round ring shape, and the impeller 12 is coaxially arranged at an inner side of the air inlet part 111. Moreover, the air inlet part 111 and the air outlet part 112 are connected by a fixing part 113. For example, the fixing part 113 can be screws, and correspondingly, standard screw holes can be provided at the air inlet part 111 and the air outlet part 112, for easy assembling and fixing.

The control unit 4 of the embodiment, for example, includes an operation panel 41 and a housing 42 for accommodating the fan member 1. The housing 42 has a drum shape and covers the fan member 1. The operation panel 41 is arranged on an outer surface of the housing 42 and communicates with the motor 13 for control. For example, the operation panel 41 is provided with five buttons, namely a "SET" key, a "MODE" key, an "UP" key, a "DOWN" key and an "ON/OFF" key. The "SET" key is to achieve parameter setting, parameter switching, and parameter input; the "MODE" key is to achieve control setting of the fan member 1 or the ionizing member 3, and entering in and waking up a power-saving mode; the "UP" key is to achieve an increase of a parameter; the "DOWN" key is to achieve a decrease of a parameter; the green "ON/OFF" key is to achieve the turning on/off the power for the controlling parts and system. In addition, the control unit 4 can be further provided with a LCD display region, to display current parameter settings in real time, for the operator's easy access and reference. When the "MODE" key is quickly pressed twice, a power-saving mode starts, and a LCD backlight is turned off; when the LCD is needed to be woken up, it is only necessary to quickly press the "MODE" key twice, the operation is simple, and the operator can easily learn.

In addition, the housing 42 is provided with a plurality of air inlets 43 arranged opposite to the impeller 12. The plurality of air inlets 43 are densely distributed in a honeycomb-shaped form, facing leafs of the impeller 12. Screw holes for fixing the fan member 1 may be provided on the bottom and side surfaces of the housing 42, to facilitate installing and fixing the fan member 1. Moreover, since the fan member 1 and the motor 13 are integrated, a shaft bearing part will be easily damaged when particles are inhaled in. Therefore, a filtering member is arranged in the housing 42 and located between the impeller 12 and the air inlets 43, to effectively prevent entrance of the particles, realizing protection for the motor 13. Of course, the filtering member can be of various types, for example, a filtering screen and so on.

In the embodiment, the ionizing member 3 includes a positive ion generating part 3-1 and a negative ion generating part 3-2 for tip discharging, wherein, both the positive ion generating part 3-1 and the negative ion generating part 3-2 are connected with an electric field generating unit, and discharge at respective tips by using a high voltage electric field generated by the electric field generating unit, so that the air passing the tips is ionized, and positive and negative ions are obtained.

In order to achieve better effect of removing the static electricity, the positive ion generating part 3-1 and the negative ion generating part 3-2 are arranged at intervals along a circumferential direction of an inner wall of the air blowing chamber 2. Correspondingly, the nozzle part 5 is also provided at a ring edge of the air blowing chamber 2. After the ionizing member 3 has been used for a period, the tips need to be maintained and particles attached to the tips should be cleared, to ensure better ion generating effect.

In summary, the device for forming air flow containing charged ions provided by the embodiment of the present invention, as a static electricity removing device, can well solve the problems of static electricity and dust in the TFT-LCD industry, and has many advantageous technical effects, which are summed up as three points as follows:

I. Capability of Effectively Removing Static Electricity

In the process for a substrate for TFT-LCD, a lot of static electricity will be accumulated on a glass substrate due to friction, conveying, contact, stripping, high temperature, low temperature, vacuum pressuring and other factors. When the quantity of the static electricity reaches a certain level, an electrostatic discharge is very easy to occur due to occasional external interference, resulting in an electrostatic breakdown on circuits in the TFT-LCD, and thus, the product yield will be adversely influenced. Some product with latent problems may flow into the client, not only causing financial losses to customers, but also bringing a bad influence on the reputation of the factory in the industry.

The static electricity removing device provided by the embodiments of the present invention employs a design idea of jet engine and turbocharger applied in the aerospace design, realizing a huge increase of air volume from one time to 15 times, so more ions for removing the static electricity are generated, to realize effectively removing the electrostatic ions attached to the glass substrate.

II. Capability of Effectively Removing Dust

In the production process of TFT-LCD products, it is desired to strictly avoid dust.

Although some defective problems can be solved by repairing, a repaired product is generally downgraded, and either downgraded products or failure products bring a considerable economic loss to the producer. In particular, for 110 inch products, the utilization of glass is low in a high-generation production line. A substrate for TFT-LCD of 8th generation line only can be used to produces one 110 inch product. However, even if there is only one dust particle on the product, the product may be directly scrapped. That is an essential reason why a large-sized product has a lower yield. Therefore, the capability of effectively removing dust is quite crucial to the TFT-LCD industry. In today's TFT-LCD industry, in order to effectively prevent the product from impact of dust, the production process needs to be carried out in an ultra-clean room. But maintaining high cleanliness in the ultra-clean room takes a very high cost.

The static electricity removing device provided by embodiments of the present invention is capable of effectively removing dust in large area, with large air volume. A huge increase of air volume from one time to 15 times can be realized by using this solution in which a Coanda effect and the viscous force of the fluid itself are fully used so that the air supplying volume can be increased without electric energy consumption.

III. Capability of Fast and Fully Cooling a Glass Substrate

The glass substrate for TFT-LCD undergoes complex and tedious During processes, some of which are performed at high temperature and high pressure; some of which are performed at low temperature and low humidity, and some of which are performed at room temperature. These processes require cooling before being performed. For example, after thermal curing of a sealant, an aging process is further needed to make liquid crystal be uniformly arranged and distributed, and between the two processes, a cooling process should be performed; furthermore, after thermal curing of a sealant, an alignment accuracy test may be required sometimes, and a cooling process is also needed to ensure test accuracy. It can be seen that, in the above processes, due to limitations to the number of layers of staging device for cooling and technical utilization rate and other requirements, cooling are required to be achieved in a relatively short period of time. When the existing art is used for shortening cooling time, the fan power should be increased, which will undoubtedly result in large loss of electric energy.

The static electricity removing device provided by embodiment of the present invention is capable of multiplying the air volume, so as to obtain a larger volume of cooled air with a lower power consumption, so the glass substrate can be fast and effectively cooled, and the process time is shortened. Meanwhile, a staging device for cooling more layers is not needed, or a larger space for storing equipment is not needed, thus reducing investment in equipment, reducing production costs.

In summary, the device for forming air flow containing charged ions provided by the embodiments of the present invention can be used as a static electricity removing device, a nozzle part facing the ionizing member is arranged on a ring edge of the air blowing chamber; under the action of air flow, the charged ions move to external environment and counteract the electrostatic charges. The static electricity removing device can improve working efficiency of air flow, and has advantages of effectively removing the static electricity, fast cooling the glass substrate and no radiation risk. Under the premise of the same power, the air supplying volume can be greatly increased, and a significant effect of removing the static electricity can be achieved; and, due to great air supplying volume, the static electricity removing device can effectively cool the glass substrate and remove the dust, greatly improving the yield of TFT-LCD product, so the static electricity removing device has a very wide application significance and promotional value.

According to the above description, the embodiments according to the present disclosure at least can provide structures as follows:

(1). A device for forming air flow containing charged ions, comprising a fan member, a ring air blowing chamber defining a center opening, and an ionizing member, wherein, the ionizing member is arranged on an inner wall of the ring air blowing chamber facing the center opening for generating the charged ions, and the ring air blowing chamber comprises a ring passage and a nozzle part, the ring passage of the ring air blowing chamber is configured to receive air flow from the fan member, and the nozzle part is configured to face to the ionizing member.

(2). The device according to claim 1, wherein, the fan member comprises a shell, an impeller and a motor; the shell comprises an air inlet part and an air outlet part connected thereto, the impeller is arranged at the air inlet part and connected with the motor, the motor is configured for driving the impeller to rotate so that an air flow is formed and arrive the ring passage of the air blowing chamber after passing through the air inlet part and the air outlet part sequentially.

(3). The device according to claim 2, wherein, the air outlet part has a horn shape with an expanding end connected with the air blowing chamber and a contracting end connected with the air inlet part.

(4). The device according to (2) or (3), wherein, the air inlet part has a round ring shape, and the impeller is coaxially arranged within the air inlet part.

(5). The device according to any one of (2) to (4), wherein, the air inlet part and the air outlet part are connected by a fixing part.

(6). The device according to any one of (2) to (5), further comprising a control unit for controlling the fan member.

(7). The device according to (6), wherein, the control unit comprises an operation panel and an housing for accommodating the fan member; the operation panel is arranged on a surface of the housing and connected with the motor; the housing is provided with a plurality of air inlets arranged opposite to the impeller.

(8). The device according to (7), wherein, a filtering member is arranged in the housing and located between the impeller and the air inlets.

(9). The device according to claim any one of (1) to (8), wherein, the ionizing member includes a positive ion generating part and a negative ion generating part which have tips for discharging respectively, the positive ion generating part and the negative ion generating part are arranged at intervals along a circumferential direction of an inner wall of the air blowing chamber.

(10). The device according to any one of (1) to (9), wherein, a nozzle part of the ring air blowing chamber consists of an extending wall and an arc wall which are opposite to each other, the arc wall is closer to the ring passage as compared with the extending wall, and one end of the arc wall is bent inward to the ring passage.

(11). The device according to any one of (1) to (10), wherein, the ring air blowing chamber has an ellipse-like ring cross section with two arc cross section parts opposite to each other and two straight cross section parts located therebetween.

(12). The device according to (11), wherein, the number of the fan members is two, and the two fan members are located on two sides of the ring air blowing chamber corresponding to the two arc cross section parts respectively.

Although the embodiment of the invention has been described above in great detail with general descriptions and specific embodiments, on the basis of the embodiment of the invention, various changes and improvements may be made, which is apparent to those skilled in the art. Therefore, all such changes and improvements without departing from the spirit of the invention are within the scope of the claims of the invention.

The present application claims priority of Chinese Patent Application No. 201510098523.9 filed on Mar. 5, 2015, the disclosure of which is incorporated herein by reference in its entirety as part of the present application.

What is claimed is:

1. A device for forming air flow containing charged ions, comprising a fan member, a ring air blowing chamber defining a center opening, and an ionizing member, wherein, the ionizing member is arranged on an inner wall of the ring air blowing chamber facing the center opening for generating the charged ions, and the ring air blowing chamber comprises a ring passage and a nozzle part, the ring passage of the ring air blowing chamber is configured to receive air flow from the fan member, and the nozzle part is configured to face to the ionizing member.

2. The device according to claim 1, wherein, the fan member comprises a shell, an impeller and a motor; the shell comprises an air inlet part and an air outlet part connected thereto, the impeller is arranged at the air inlet part and connected with the motor, the motor is configured for driving the impeller to rotate so that an air flow is formed and arrive the ring passage of the air blowing chamber after passing through the air inlet part and the air outlet part sequentially.

3. The device according to claim 2, wherein, the air outlet part has a horn shape with an expanding end connected with the air blowing chamber and a contracting end connected with the air inlet part.

4. The device according to claim 2, wherein, the air inlet part has a round ring shape, and the impeller is coaxially arranged within the air inlet part.

5. The device according to claim 2, wherein, the air inlet part and the air outlet part are connected by a fixing part.

6. The device according to claim 2, further comprising a control unit for controlling the fan member.

7. The device according to claim 6, wherein, the control unit comprises an operation panel and a housing for accommodating the fan member; the operation panel is arranged on a surface of the housing and connected with the motor; the housing is provided with a plurality of air inlets arranged opposite to the impeller.

8. The device according to claim 7, wherein, a filtering member is arranged in the housing and located between the impeller and the air inlets.

9. The device according to claim 1, wherein, the ionizing member includes a positive ion generating part and a negative ion generating part which have tips for discharging respectively, the positive ion generating part and the negative ion generating part are arranged at intervals along a circumferential direction of an inner wall of the air blowing chamber.

10. The device according to claim 1, wherein, a nozzle part of the ring air blowing chamber consists of an extending wall and an arc wall which are opposite to each other, the arc wall is closer to the ring passage as compared with the extending wall, and one end of the arc wall is bent inward to the ring passage.

11. The device according to claim 1, wherein, the ring air blowing chamber has an ellipse-like ring cross section with two arc cross section parts opposite to each other and two straight cross section parts located therebetween.

12. The device according to claim 11, wherein, the number of the fan members is two, and the two fan members are located on two sides of the ring air blowing chamber corresponding to the two arc cross section parts respectively.

13. The device according to claim 1, wherein, the nozzle part is configured to output at least part of the air flow from the ring passage to the ionizing member.

* * * * *